US006997093B2

(12) United States Patent
Koehler et al.

(10) Patent No.: US 6,997,093 B2
(45) Date of Patent: Feb. 14, 2006

(54) CROSS WEB SHEAR APPARATUS

(75) Inventors: Philip A. Koehler, River Falls, WI (US); Steven F. Nagel, Hudson, WI (US)

(73) Assignee: Doboy Inc., New Richmond, WI (US)

( * ) Notice: Subject to any disclaimer, the term of this patent is extended or adjusted under 35 U.S.C. 154(b) by 0 days.

(21) Appl. No.: 10/462,508

(22) Filed: Jun. 16, 2003

(65) Prior Publication Data

US 2003/0209317 A1 Nov. 13, 2003

Related U.S. Application Data

(62) Division of application No. 09/698,009, filed on Oct. 26, 2000, now Pat. No. 6,722,413.

(51) Int. Cl.
*B26D 5/08* (2006.01)
*B26D 5/16* (2006.01)

(52) U.S. Cl. ..... 83/609; 83/825; 83/694; 83/949; 83/649; 83/646; 83/611; 83/602; 156/519

(58) Field of Classification Search ..... 83/24, 83/29, 56, 152, 94, 100, 614, 626, 628, 632, 83/633, 635, 636, 638, 625, 602, 604, 609, 83/611, 605, 694, 949, 649, 650, 154, 697; 156/250, 256, 436, 510, 517, 519, 521, 556, 156/576, 568
See application file for complete search history.

(56) References Cited

U.S. PATENT DOCUMENTS 2,130,818 A * 9/1938 Soderberg ..... 83/56
2,691,517 A * 10/1954 Schwartz et al. ..... 177/161
3,577,702 A * 5/1971 Bescript ..... 53/587
3,745,893 A 7/1973 Helm et al.
3,757,624 A * 9/1973 Kruse et al. ..... 83/271
4,003,281 A * 1/1977 Kumpf et al. ..... 83/477.2
4,025,373 A 5/1977 Hirsch et al.
4,083,737 A 4/1978 Foote et al.
4,197,154 A 4/1980 Pfaff, Jr.
4,429,602 A * 2/1984 Vits ..... 83/24
4,463,693 A 8/1984 Dreier et al.
4,549,454 A * 10/1985 Yamashita ..... 83/27
4,922,775 A * 5/1990 Winter ..... 83/333
4,925,520 A 5/1990 Beaudoin et al.
5,037,138 A 8/1991 McClintock et al.
5,041,073 A 8/1991 Eicker
5,125,307 A * 6/1992 Jackson ..... 83/605
5,235,887 A * 8/1993 Moriya ..... 83/282
5,331,741 A 7/1994 Taylor, Jr.
5,584,954 A 12/1996 Van der Klugt (Continued)

FOREIGN PATENT DOCUMENTS

EP 0 051 076 A 12/1982

(Continued)

*Primary Examiner*—Boyer D. Ashley
(74) *Attorney, Agent, or Firm*—Oppenheimer Wolff & Donnelly LLP

(57) ABSTRACT

In order to selectively reinforce portions of a material web, a cutting and laminating device efficiently produces the required reinforcing strips and then laminates them to the web. In order to efficiently and accurately produce these reinforcing strips, a cross web shear is utilized which is capable of cutting required reinforcing strips from the fairly large web of reinforcing material in an accurate manner. Once cut, a holding and positioning device is capable of grabbing onto the reinforcing strip and appropriately positioning it next to the primary material web. A separate laminator can then attach this reinforcing strip to the web at a desired location.

8 Claims, 12 Drawing Sheets

U.S. PATENT DOCUMENTS

| | | | | |
|---|---|---|---|---|
| 5,928,749 | A | 7/1999 | Forman | |
| 5,937,615 | A | 8/1999 | Forman | |
| 5,944,425 | A | 8/1999 | Forman | |
| 5,977,866 | A | 11/1999 | Joseph, Jr. et al. | |
| 5,983,594 | A | 11/1999 | Forman | |
| 6,139,662 | A | 10/2000 | Forman | |
| 6,189,469 | B1 | 2/2001 | Fukumoto | |
| 6,210,515 | B1 | 4/2001 | Boreali et al. | |
| 6,722,413 | B1 * | 4/2004 | Koehler et al. | 156/519 |

FOREIGN PATENT DOCUMENTS

| | | |
|---|---|---|
| WO | WO 97/16370 | 9/1997 |

* cited by examiner

CROSS WEB SHEAR APPARATUS

This application is a divisional of prior application Ser. No. 09/698,009, filed on Oct. 26, 2000 now U.S. Pat. No. 6,722,413.

BACKGROUND OF THE INVENTION

The present invention relates to manufacturing equipment and manufacturing processes utilizing a continuous web of material. For example, the present invention may be used to reinforce portions of flexible packaging material. More specifically, the present invention relates to a system and process for reinforcing portions of a web, which can be supplied to subsequent processing equipment and operations.

Many web-based processes presently exist for various types of manufacturing. In each of these processes, bulk raw materials are supplied to various systems in a web format for further manipulation or processing. These bulk supplies of material often take the form of very large rolls which can then be unwound appropriately to create a web. More specifically, the material is unwound and fed into the processing machines, forming a web. In the packaging industry, these webs often take the form of plastics which will be formed into bags, containers or other enclosures. For example, the supply web may be wrapped around existing products, and then sealed at three or four edges to completely enclose the particular product.

Web manufacturing processes are typically very desirable due to the high speeds and efficiencies which can be achieved. For example, it is fairly easy to move material webs along a desired path using various rollers, including handling rollers and drive rollers. Similarly, in-line cutters and sealers can very easily be incorporated into these manufacturing processes as well. Because these operations are being done "in line", they can be very quickly accomplished. It is fairly well known, however, that operations transverse to the web are less easily carried out and more complicated.

In these web-based processes, the actual material being used will dictate the capabilities and constraints of possible activities. Ideally, the material web is flexible and relatively strong. Consequently, material can be pulled through various rollers and various manufacturing apparatus without the fear of breaking or severing. Conversely, if a material is too rigid, it does not easily move through the manufacturing process, and is not easily manipulated. Further complications are encountered when this relatively heavy or rigid material must be cut or severed in any way. More specifically, it is difficult to achieve precise cuts of this more rigid material, especially when attempting to cut in a direction transverse to the web. Further, when working with a web that is quite wide, these transverse cuts become fairly long, which creates significant difficulties. Existing cutting mechanisms are not capable of precisely creating these long cross-web cuts.

Another complication of web-based manufacturing processes is the necessity to reinforce certain portions of the web. In particular, it may be desirable to reinforce only certain portions of the web, due to later operations that may be performed on only a portion of the web. For example, it may be desirable to reinforce the seal region where various layers of material are joined together. Reinforcing only a portion of the web introduces positioning and alignment complications however. As can be easily appreciated, this reinforcement operation becomes particularly difficult when it must be positioned transverse to the web. Additionally, the small strips of reinforcing material typically used are often difficult to handle.

One approach to reinforcing web at predetermined locations is to utilize a preformed roll of reinforcing material and applying it at appropriate locations. This roll of reinforcing material is specifically configured for this purpose and is typically much smaller than the actual web itself. For example, one typical application may require a web approximately 2 to 4 feet wide, but may require reinforcing strips only 1 inch wide. When purchased as exclusive rolls of reinforcing material, these rolls are specifically produced in the desired narrow width. While this affords some manufacturing efficiencies by utilizing pre-sized reinforcing material, additional cost is inherently added to the process. These prefabricated "narrow" rolls of reinforcing material are necessarily more expensive than similar product purchased in larger bulk format. Consequently, it would be desirable to utilize a more cost effective method of manufacturing which utilizes larger bulk materials. This is particularly true when the reinforcing material itself is a heavier, more expensive product to begin with.

In addition to the additional cost, when incorporating cross web reinforcement using these narrow rolls, the process is inherently slow. Material must be moved in a direction transverse to the web, rather than in line with the web. As with all web manufacturing, it is highly desirable to have all operations moving along with the web.

While the desirability of using bulk reinforcing materials may appear obvious, this does introduce more significant cutting and manipulating operations, as outlined above. Present day equipment is not capable of efficiently producing the necessary reinforcing strips from bulk webs of material.

SUMMARY OF THE INVENTION

In order to provide an efficient and cost effective method for reinforcing selected portions of a web, the present invention provides a mechanism which utilizes a large format supply of reinforcing material to selectively reinforce portions of a primary web. In order to accomplish this reinforcement the present invention includes a primary web handling system and a secondary web handling system, a cross web shear, a strip handling system and a laminating device. The primary web handling system handles the main web of packaging material, or primary web, which will be reinforced for later operations.

In order to provide this reinforcement, reinforcing strips are produced from the secondary web and then laminated to the primary web. Specifically, the secondary supply web provides reinforcing material to the cross web shear which cuts the secondary web into reinforcing strips of predefined width. Subsequently, this strip of reinforcing material is provided to a handling mechanism for moving the reinforcing strip to a predetermined location for attachment to the primary web. The laminating device is then utilized to attach this reinforcing strip.

To accomplish the complicated task of cross web cutting, the cross web shear of the present invention is uniquely configured. The cross web shear includes a radiused blade and a cam follower structure in order to initiate a single point cutting action. The cam follower structure, and all related driving devices, move the blade through a predetermined rocking type motion. By using the radiused cutting edge of the blade in this rocking type motion, only a single point of the blade is actually cutting at any particular point in time.

This configuration allows for precise cross web cutting of the reinforcing material itself into the desired reinforcing strips.

In order to appropriately reinforce the primary web, the handling mechanism includes a vacuum manifold structure to grab the reinforcing strip and move it to its desired location. In one particular application, this reinforcing strip is relatively narrow and small compared to the primary web. Consequently, moving and handling of this component is complicated. This is especially true when desired precision is necessary. The vacuum manifold is capable of precisely capturing the reinforcing strip and moving it via an attached positioning device. The positioning device is then capable of moving the manifold to a desired location which is adjacent the laminating device. Lamination of the reinforcing strip can then easily be accomplished.

It is an object of the present invention to create a device for reinforcing a primary web at predetermined locations.

It is a further object of the present invention to provide a cross web shear capable of cutting reinforcing material into reinforcing strips of a desired size. The cross web shear fabricates these reinforcing strips from a bulk supply web and incorporates precision cuts to control the size and configuration of the reinforcing strip itself.

It is a further object of the present invention to create reinforcing strips from a bulk stock of reinforcing material. This reinforcing material supply can be provided in a secondary web format for efficient and cost effective creation of reinforcing strips.

It is a further object of the present invention to create reinforcing strips using a cross web shear, appropriately position these reinforcing strips adjacent to a primary web, and attach these reinforcing strips to the primary web. Consequently, the primary web is reinforced at predetermined locations to easily accommodate further operations.

BRIEF DESCRIPTION OF THE DRAWINGS

Further objects and advantages of the present invention can be seen by reading the following detailed description in conjunction with the drawings in which.

DETAILED DESCRIPTION OF PREFERRED EMBODIMENTS

As mentioned above, the present invention relates to manufacturing equipment for use in web based manufacturing operations. More specifically, the apparatus and methods of the present invention provide for the reinforcing of a primary web of material which can then be supplied to further manufacturing operations. For example, the reinforced web may be used to produce other products, such as bags or other containers for holding and containing other materials. In its most common environment, the apparatus and system of the present invention will be a component of a larger manufacturing operation and achieves the step of reinforcing the web material for use in further operations.

Figure 1:
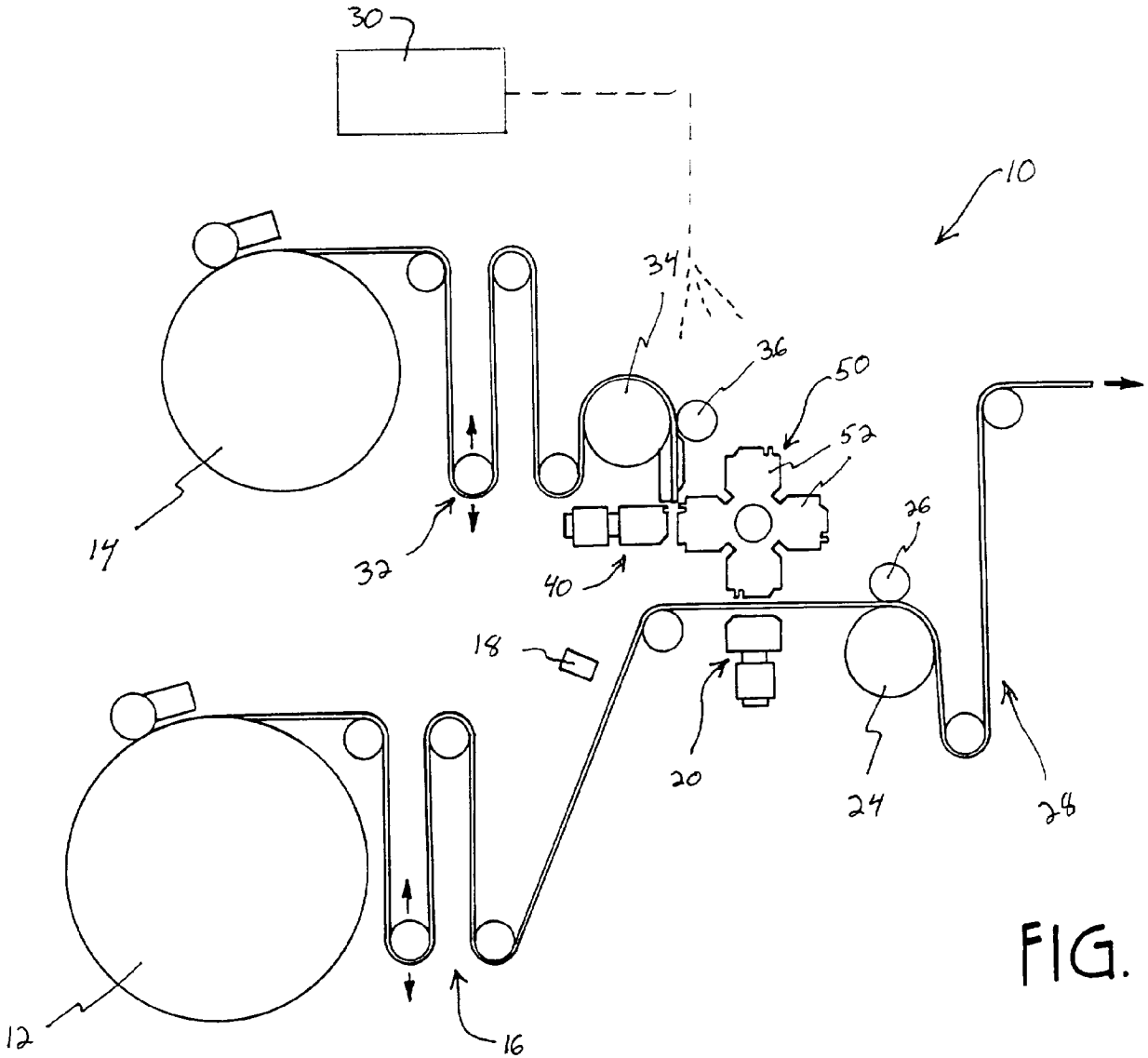
FIG. 1 is a schematic illustration of the cutting and laminating device.
Figure 4:
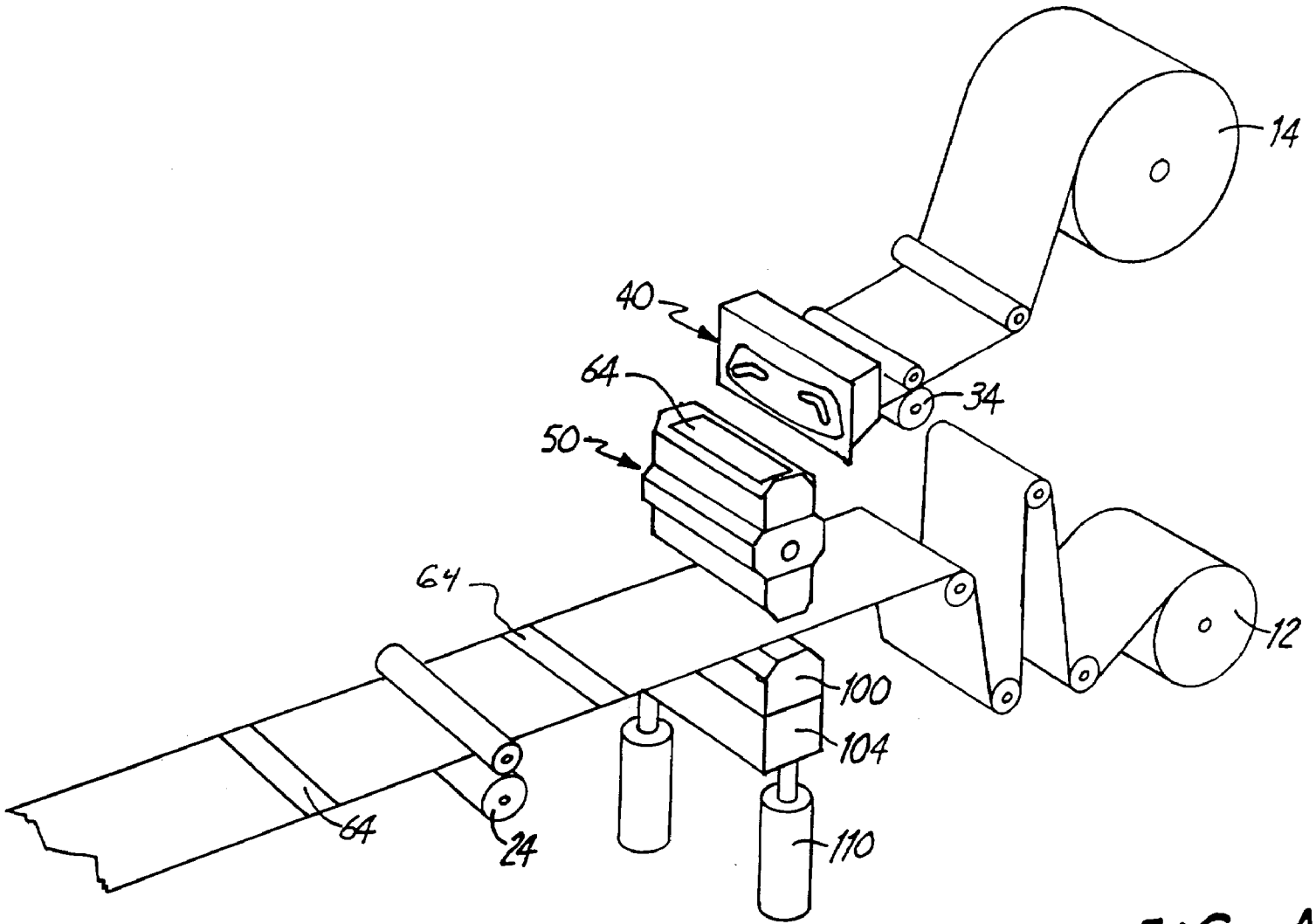
FIG. 4 is a perspective view of the major components of the cutting and laminating device.

Referring now to FIGS. 1 and 4 there is shown schematic and perspective illustrations of the cutting and laminating apparatus (10) of the present invention. Mounted within the cutting and laminating apparatus is a primary supply web (12) and a secondary supply web (14). In this embodiment, the primary supply web contains the material which will be reinforced and later fed to subsequent manufacturing operations. Secondary supply web contains the material that will be used for reinforcing the primary supply web. For example, primary supply web (12) may include a large roll of oriented polypropylene, high density polyethylene, metalized oriented polypropylene, or other standard packaging materials. Similarly, secondary supply web may be a roll of label film, barrier film, blister forming material, adhesive material, tear strip material, or other additional films/material. Alternatively, secondary supply web (14) may be the same as the primary supply web (with the same or differing gauges), depending on the particular needs of the application.

The output from primary supply web (12) is fed through a series of dancer rollers (16) which operate as a supply holding buffer. Further, these rollers help to manipulate and straighten the material from primary supply web (12). Next, the primary supply web is directed past a registration eye (18) in order to insure a proper alignment and positioning of the web. The primary web (12) is then directed above laminating device (20). As will be further described, laminating device (20) is operable to laminate the reinforcing strip to the primary web at appropriate positions and times.

This movement of the web is controlled by a primary feed roller (24) which controls all movement of the primary web. Primary feed roller (24) is a servo controlled roller which operates in conjunction with a pinch roller (26) to accurately control any movement on the primary web. Downstream from the primary feed roller is a output buffer (28), shown here as a pair of rollers.

As further shown in FIG. 1, the secondary supply web (14) supplies material for web reinforcement. More specifically, the material from secondary supply web is first fed through a series of dancer rollers (32), which again operate as a supply buffer. From these dancer rollers (32) the material is provided to a secondary feed roller (34) which cooperates with a second pinch roller (36) to control the movement of the secondary web. The secondary feed roller (34), directs appropriate portions of the secondary web (14) to a cross web shear (40) which cooperates with an applicator head (50) to produce reinforcing strips. As will be further described, secondary feed roller (34) positions the secondary web (14) adjacent to cross web shear (40) such that a reinforcing strip can be cut from the secondary web (14). Cross web shear (40) will then be actuated to shear the reinforcing strip from secondary web (14). Applicator head (50) is appropriately aligned adjacent cross web shear (40) so that it can hold and reposition the reinforcing strip appropriately. More specifically, applicator head (50) will move the reinforcing strip to a position adjacent primary web (12) and laminating device (20). Laminating device (20) is then capable of laminating the reinforcing strip to the primary web at the appropriate location.

Many of the various components shown on FIG. 1 require a coordinated control to insure proper operation of the cutting and laminating apparatus (10). For example, primary feed roller (24) and secondary feed roller (34) must both be appropriately controlled to position the primary web and the secondary web (respectively) so that proper operations can be formed on those materials. Further, cross web shear (40) must be appropriately controlled to provide the cutting/shearing desired. Similarly, applicator heard (50), laminating device (20) and other components require this centralized control. Controller (30) is thus coupled to all necessary components of cutting and laminating apparatus (10) in order to comprehensively control its operation. As will be clearly understood by those skilled in the art, controller (30) may be a dedicated controller coupled to each specific apparatus, or may be a centralized controller, coupled to various individual device controllers on each of the products themselves.

As can be seen in FIG. 1, one embodiment of the applicator head (50) includes four separate manifold heads (52), each of which are capable of holding and positioning a reinforcing strip. In this particular embodiment, applicator head (50) is rotated approximately 90 degrees to move the reinforcing strip from its cutting location to its sealing location. As will be further illustrated, other configurations are possible for this arrangement, depending on various equipment layouts and process needs. For example, different numbers of manifold heads could be used, or a non-rotational movement path could be followed.

Figure 2:
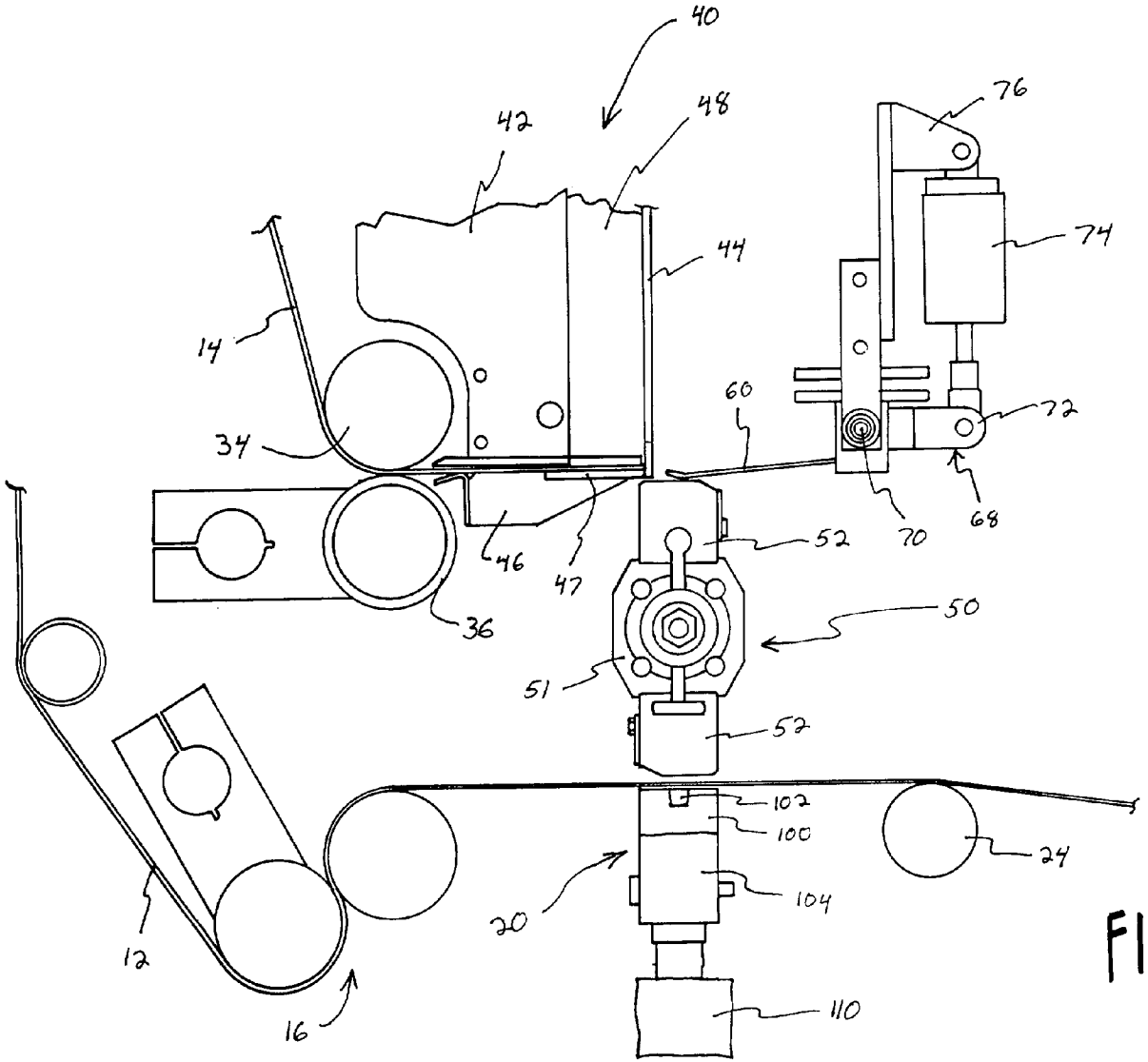
FIG. 2 is a more detailed illustration of the actual cutting apparatus, and the sealing apparatus.
Figure 3:
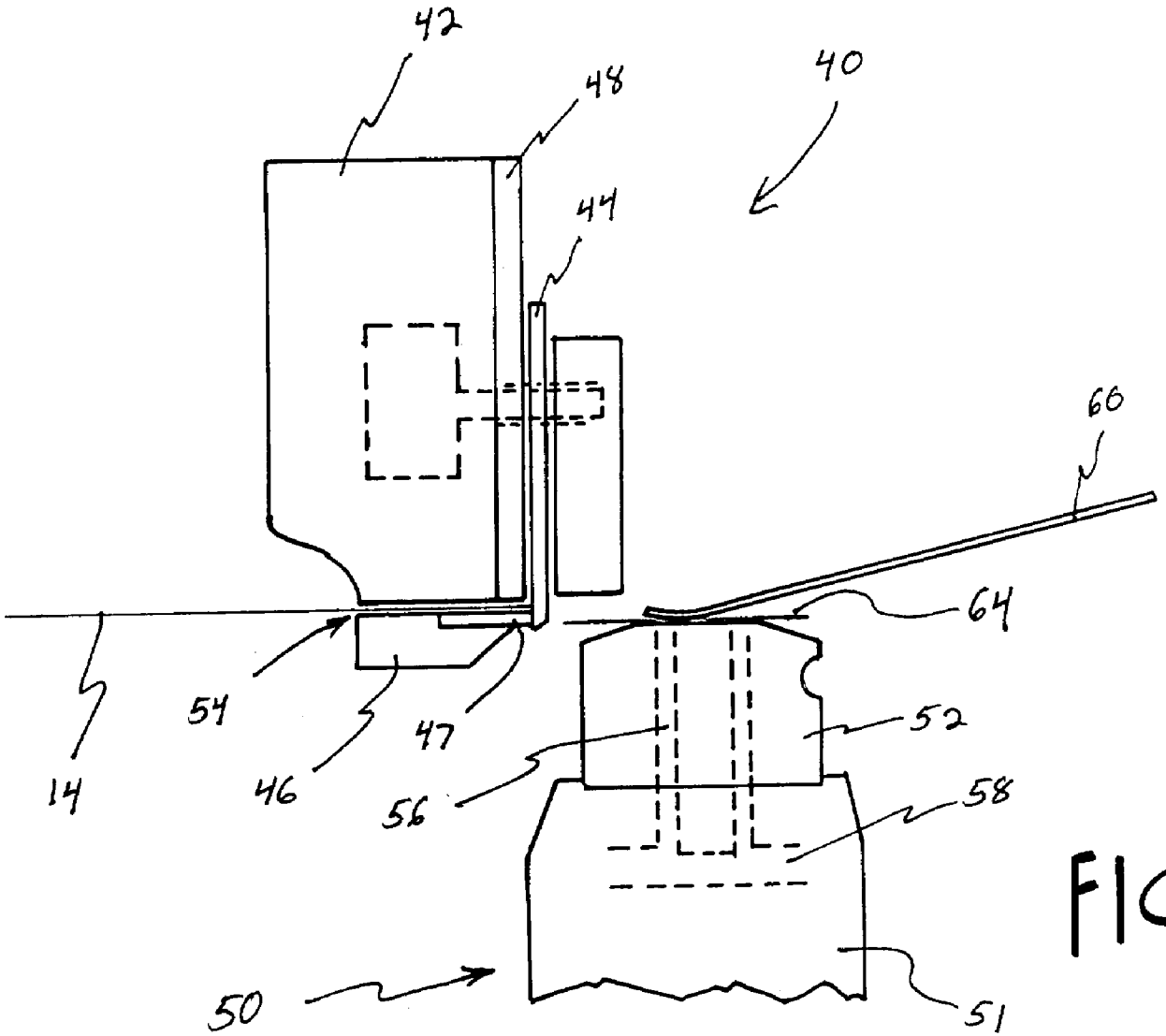
FIG. 3 is a side cross-sectional view of the cross web shear and the strip handling manifold.

Referring now to FIGS. 2 and 3 there are shown more detailed diagrams illustrating the configuration of cross web shear (40), applicator head (50) and various components thereof.

Cross web shear (40), generally includes a mounting block (42) which is attachable to the framework of the cutting and laminating apparatus (10). Further, cross web shear includes a shear blade (44) and a web support (46). Also included is a slide plate (48) designed to support and accommodate the easy movement of shear blade (44). Web support (46) includes a support blade (47) which cooperates with shear blade (44) to perform the necessary cutting of secondary web (14).

As can be seen, cross web shear (40) is positioned adjacent to applicator head (50). More specifically, cross web shear (40) has a material feeding gap (54) which exists immediately above web support (46) and below mounting block (42). Secondary web (14) passes through gap (54) and is appropriately positioned for shearing. As the material extends through gap (54), it will pass directly above applicator manifold (52). This allows applicator manifold (52) to hold the extending portion of secondary web (14) during the shearing process.

Cooperating with applicator manifold (52) is a holding clamp (60) which is configured to help hold the reinforcing strip in place when cut. Referring specifically to FIG. 3, a laminating strip (64) is shown after being cut and while being held in place by holding clamp (60) and applicator manifold (52). As can be seen, applicator manifold (52) includes a number of internal vacuum chambers (56) which are fluidly attached to similar vacuum chambers (58) in rotating block (51). Together, each of these vacuum chambers cooperate to hold reinforcing strip (64) on an upper surface of applicator manifold (52). Various vacuum controls (not shown) are utilized to control this vacuum signal structure.

Referring specifically to FIG. 2, more details are shown regarding the holding clamp (60) and related mechanisms. As can been seen, holding clamp (60) is moveable between a first position and a second position to allow the feeding and holding of reinforcing strip (64). Holding clamp (60) is configured as an elongated tab which is attached to a rotation block (68) which is rotatable round about a central axis (70). An actuating tab (72) extends in a direction opposite of holding clamp (60). Attached to one end of actuating tab (72) is a tab actuating cylinder (74). The opposite end of actuating cylinder (74) is attached to a holding frame (76). This holding frame (76) is then rigidly attached to the framework of cutting and laminating apparatus. In operation, actuating cylinder (74) is moveable between multiple positions, which cause related movement of holding clamp (60). Through this configuration, holding clamp (60) can be moved between its holding position and a feeding position which allows secondary web (14) to be fed through a feeding gap thus extending above applicator manifold (52).

Holding clamp (60) cooperates with applicator head (50) in order to appropriately hold the extending portion of secondary web (14) prior to cutting, and also hold the reinforcing strip, after sheared from the secondary web. When the secondary web is fed through cross web shear (40) it will then extend over the top of applicator manifold (52). Prior to cutting, tab actuating cylinder (74) will be actuated causing holding tab (60) to move downward (as shown in FIG. 2) thus pressing secondary web (14) against the top surface of applicator manifold (52). Simultaneously, vacuum signals will be generated within applicator manifold (52), thus also pulling secondary web (14) into contact with applicator manifold (52). Once in this configuration, cross web shear (40) can then be activated causing shear blade (44) and support blade (47) to shear a portion of secondary web (14) thus creating reinforcing strip (64). By holding or capturing reinforcing strip (64)/secondary web (14) in this manner, a precision cut can be achieved by cross web shear (40).

Referring now to FIG. 5 there is shown multiple positional diagrams illustrating the movement of shear blade (44). As can be seen, shear blade (44) is held against slide plate (48) via a pair of cam follower pins (140). Cam follower pins (140) are attached to a main framework (146) in order to maintain constant separation. Cam pins (140) and framework (146) follow a predetermined path during a cutting stroke. The main framework (146) is moved through this predetermined path by a cam actuator (160) which includes a pair of push rods (162). The extension of push rods (162) causes lateral movement of main framework (146) and cam pins (140). As can also be seen, a pair of guiding tracks (150) are provided in cutting blade (44) to direct its motion. As is fairly well known by those involved with cam follower mechanisms, the movement of cam follower pins (140) causes a controlled movement of shear blade (44). In this particular embodiment, shear blade (44) goes through a generally rocking type motion in order to efficiently shear the reinforcing material of secondary web (14).

Also shown in FIG. 5 is an additional cam framework (152) which is designed to prevent lateral movement of the blade when cam follower pins (140) are moved laterally. Cam framework (152) includes a cam track (154) which is in a generally vertical orientation (although not perpendicular to support blade (47)). Cooperating with cam track (154) is a blade cam follower (156). Blade cam follower (156) is attached to blade (44) and consequently moves therewith. As can be seen, blade cam follower (156), will follow cam track (154) as the main cam follower pins (140) move along their path. Further, blade cam follower (156) prevents lateral movement and further directs shear blade (44) through its desired motion.

Figure 5A:
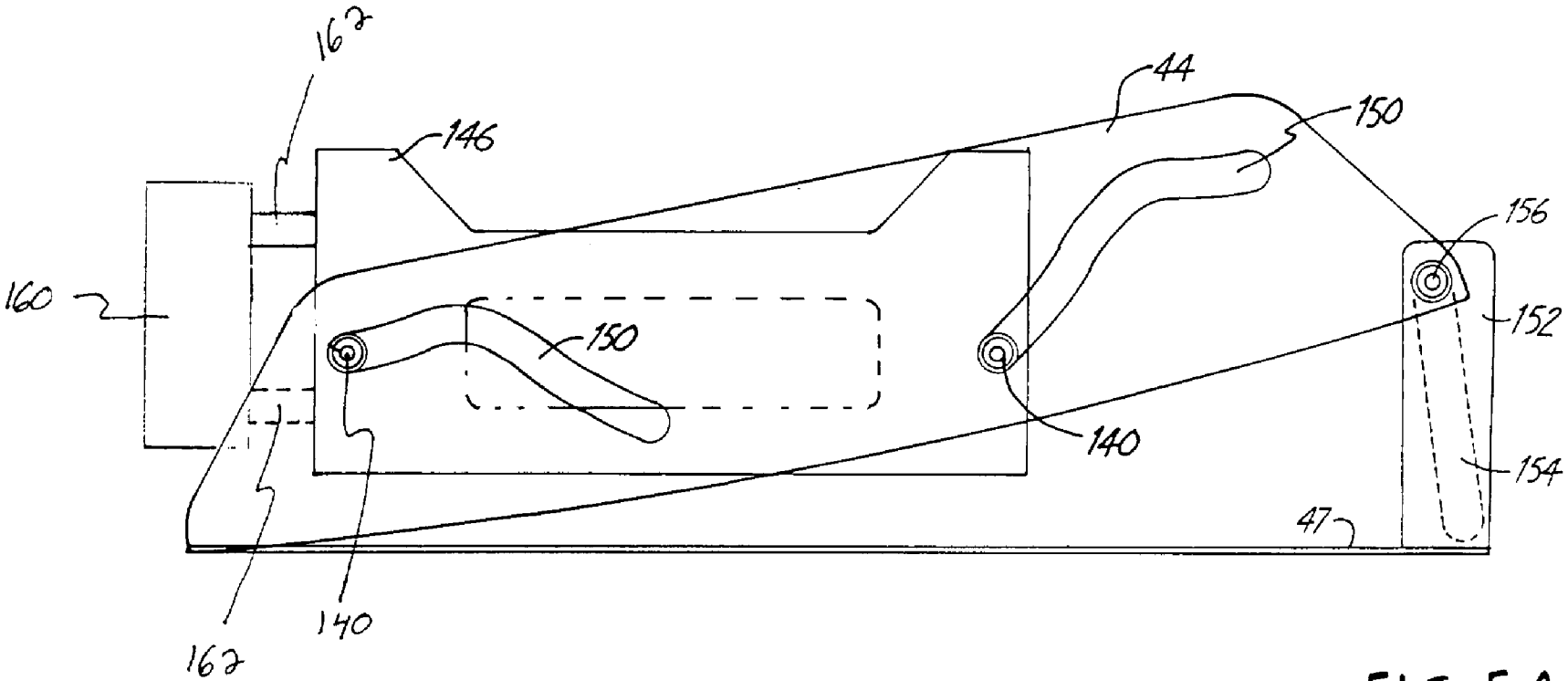
FIGS. 5A–5E are segmented drawings illustrating the various positions taken by the shear blade during its stroke.
Figure 5B:
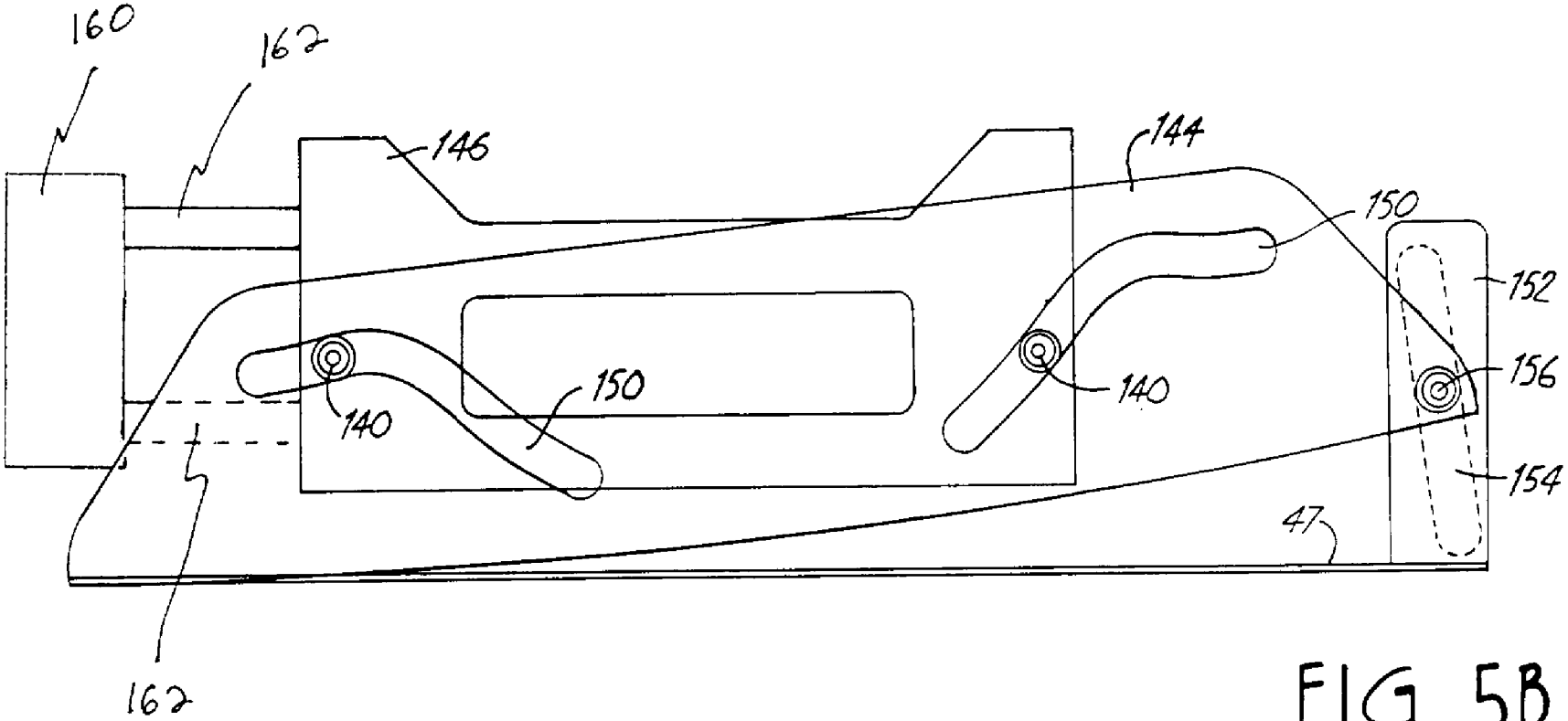
Figure 5C:
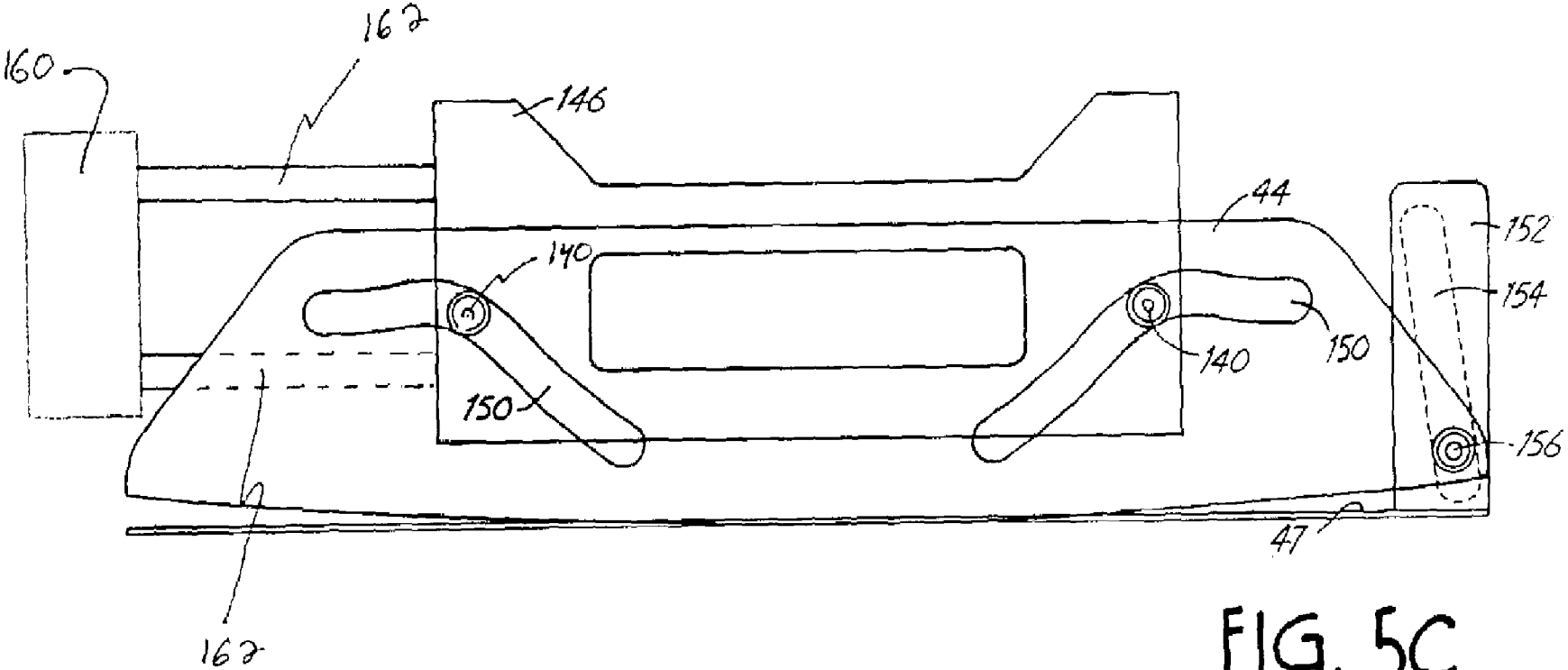
Figure 5D:
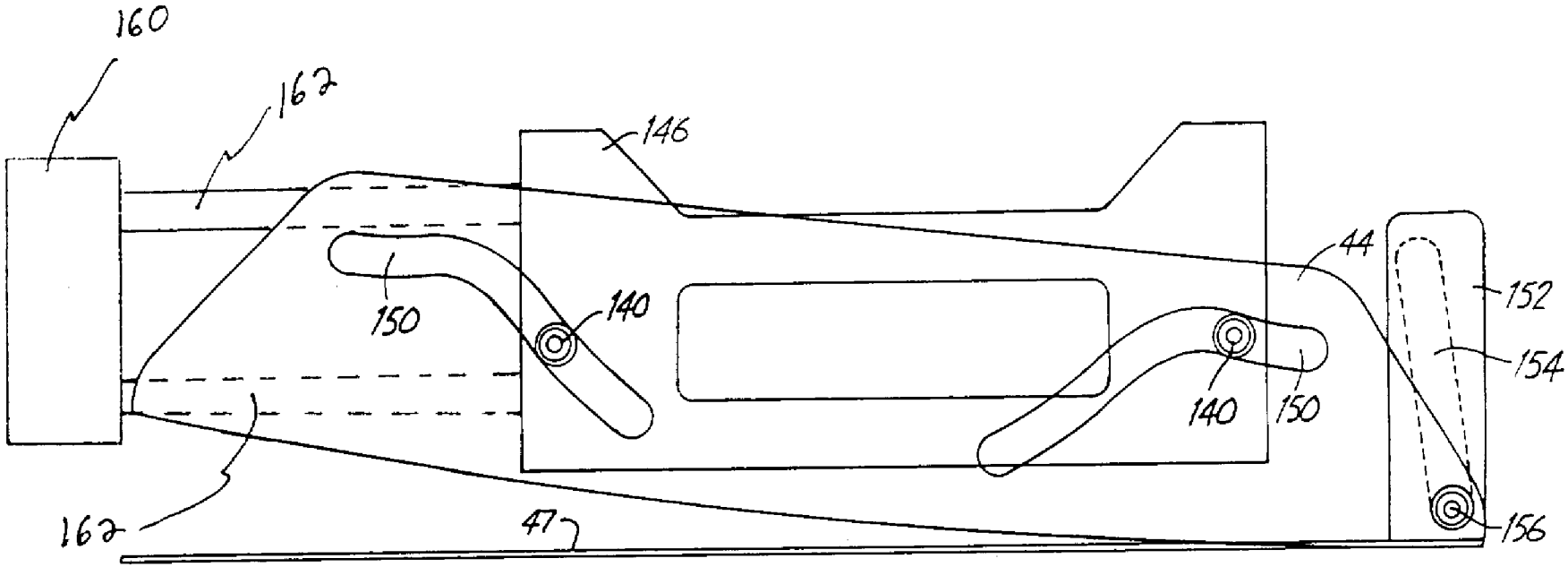
Figure 5E:
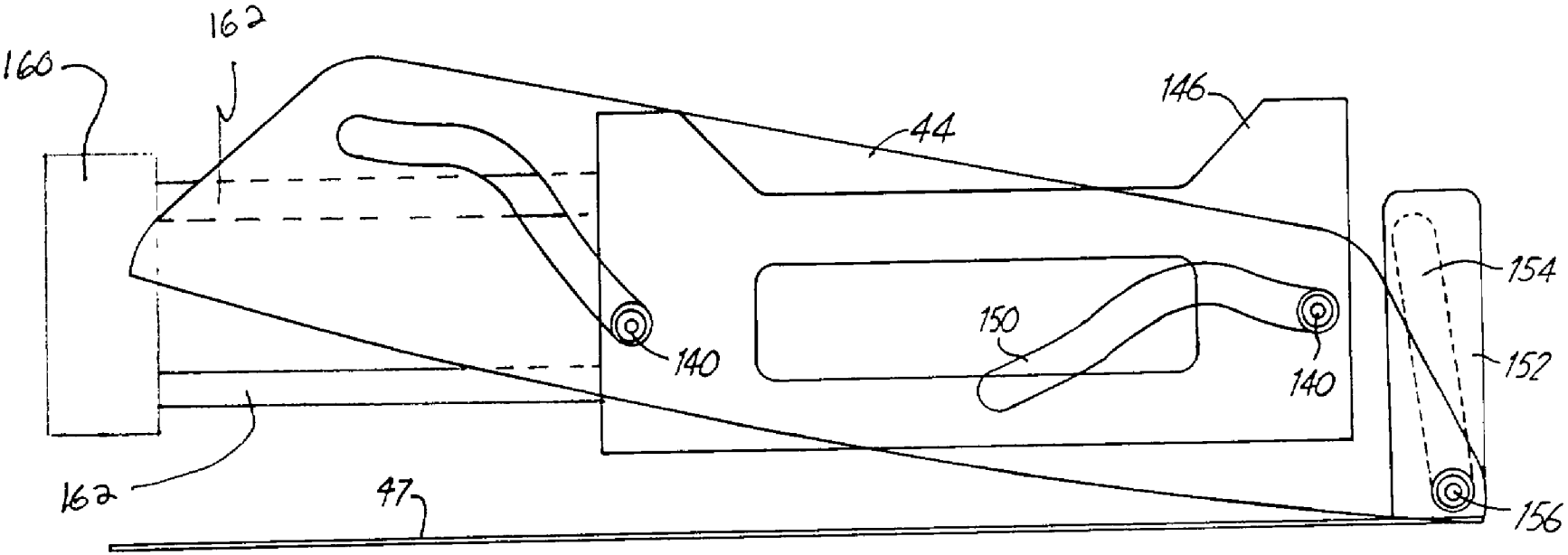

The movement of shear blade (44) can be seen by sequentially viewing FIGS. 5A–5E. As can be seen, shear blade (44) and framework (146) are at one end of their travel in FIG. 5A. In FIG. 5C, framework (146) has traveled one half of its full travel distance, thus moving shear blade to a central position. Lastly, FIG. 5E shows shear blade (44) and framework (146) having completed their travel range.

By utilizing a "rocking" motion for shear blade (44), the cross web shear (40) of the present invention is able to more accurately and efficiently shear secondary web into a number of reinforcing strips. This is especially true when utilizing heavy weight material for cross web shear which does not necessarily easily cut. Often times problem are encountered in the precise cutting of this heavy weight material. The cross web shear of the present invention addresses these problems by incorporating this rocking blade motion.

In addition to the above-mentioned desirable characteristics of this rocking motion, the blade travel is also closely controlled. As shown in FIGS. 1, 2, 3 and 4, cross web shear (40) is located in close proximity to the applicator head (50). Consequently, the actual travel of shear blade (44) must be carefully controlled so as to allow appropriate movement of applicator head (50). Specifically, shear blade (44) cannot travel any significant distance below support blade (47), in order to avoid interference with applicator head (50). As can be seen by referring to FIGS. 5A–5E, shear blade (44) extends only a small amount below support blade (47) at any point in time. More significantly, the actual distance which shear blade (44) extends below support blade (47) is very carefully controlled and kept at a minimum to avoid interference with applicator head (50). By controlling this relationship, creative flexibility is afforded in designing any related components.

Figure 6:
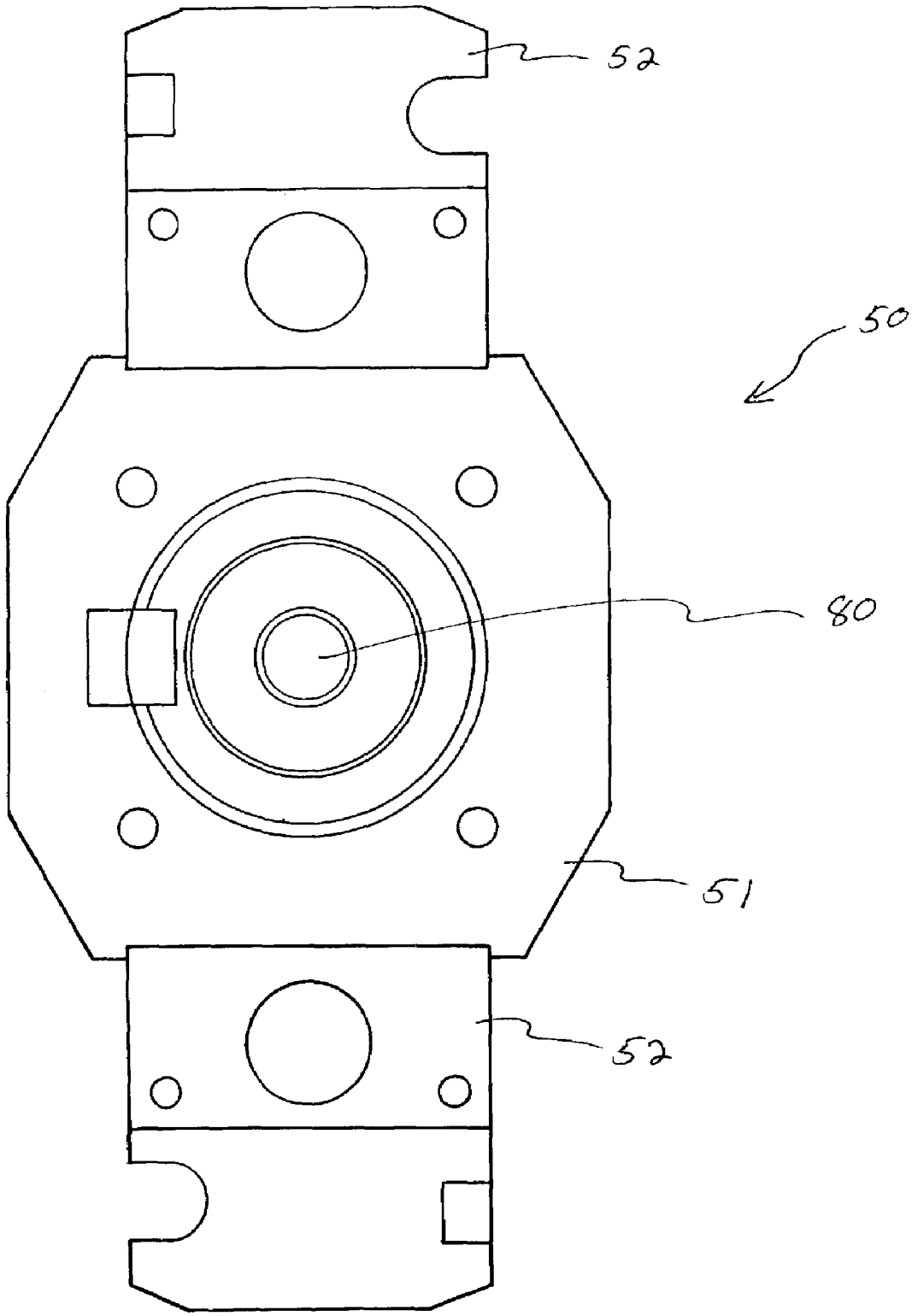
FIG. 6 is a cross-sectional diagram illustrating the strip handling manifold.
Figure 7:
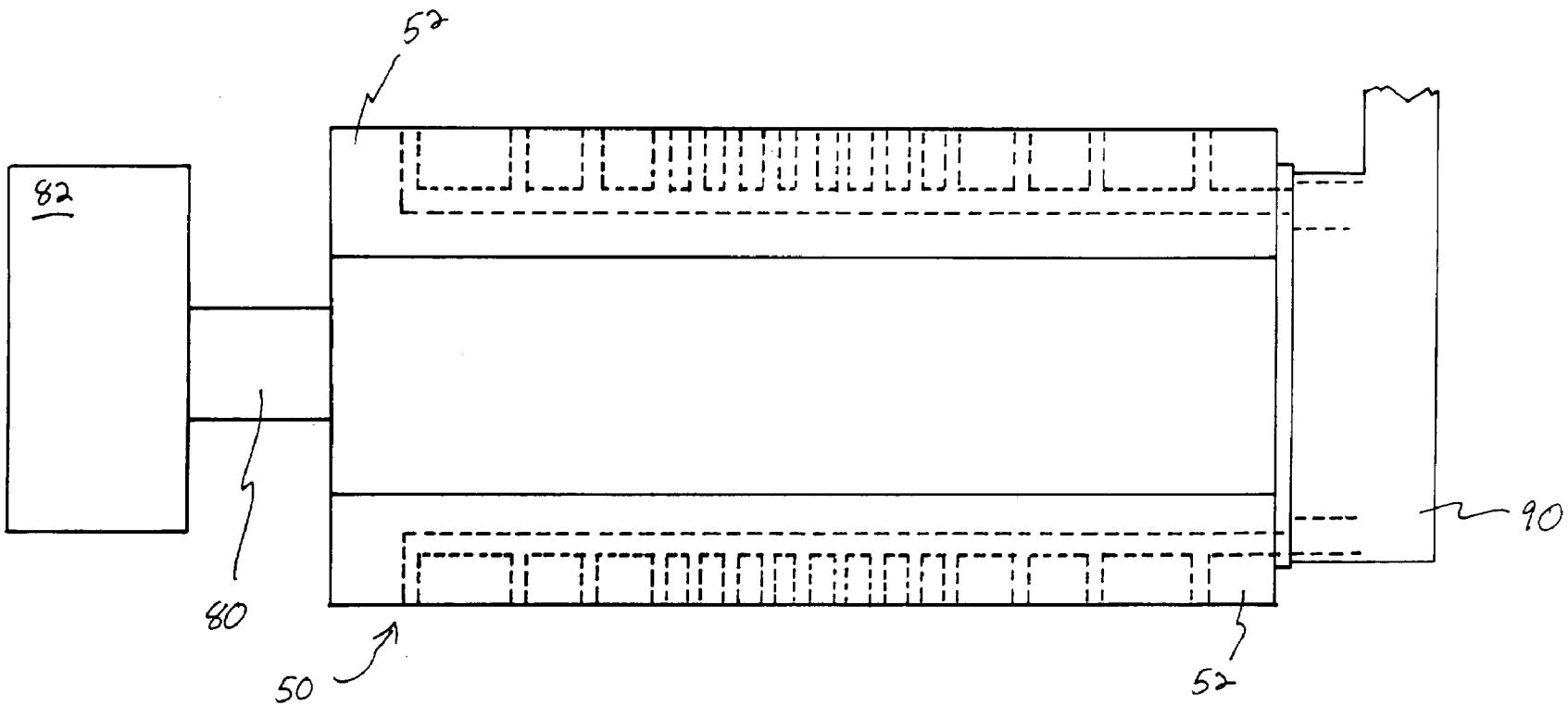
FIG. 7 is a second cross-sectional diagram of the strip handling manifold.

Referring specifically to FIGS. 6 and 7, there is shown more detailed cross-sectional views of applicator head (50). More specifically, FIG. 6 shows an end cross-sectional view while FIG. 7 shows a side cross-sectional view. As previously mentioned, a pair of applicator manifolds (52) are attached to a central rotation block (51) to achieve the appropriate holding and positioning functions of applicator head (50). Rotation block (51) is rotatable around a central axis (80) in order to accommodate movement of the reinforcing strips. The cross web shear (40) and laminating device (20) are appropriately positioned relative to the application head (52) to accommodate this 180 degree rotational move. Referring to FIG. 7, it can be seen that rotation shaft (80) is attached to a shaft drive (82) which is used to appropriate move applicator head (50) when necessary. Be understood that this is a servo controlled drive motor which is capable of precise angular positioning of the attached rotation shaft (80).

Located on an opposite end of applicator head (50) is a vacuum signal feed manifold (90) which is operatively coupled to rotation block vacuum chamber (58). Consequently, appropriate vacuum signals can be introduced at vacuum signal feed manifold (90) and then transferred to application head (50). As will be recognized, appropriate valves and vacuum supply sources can be easily attached to vacuum signal feed manifold (90). The vacuum signals are then passed to rotation block vacuum chamber (58) via a vacuum coupling (92), while also allowing applicator head (50) to be rotatable.

As previously mentioned, the reinforcing strip (64) must be attached to primary web (12) at an appropriate position. In order to accomplish this attachment, laminating device (20) is utilized. As can be seen in FIG. 2, laminating device (20) includes a laminating head (100) which has an integral heating element (102). As can be appreciated, heating element (102) provides sufficient heat to a heat seal reinforcing strip (64) to primary web (12). Laminating head (100) is attached to a mounting structure (104) which in turn is attached to the piston of laminating cylinder (110). Actuating laminating cylinder (110) causes laminating head (100) to move upward, thus ultimately contacting primary web (12). Heat is then applied via heating element (102) resulting in the desired heat sealing.

Figure 8:
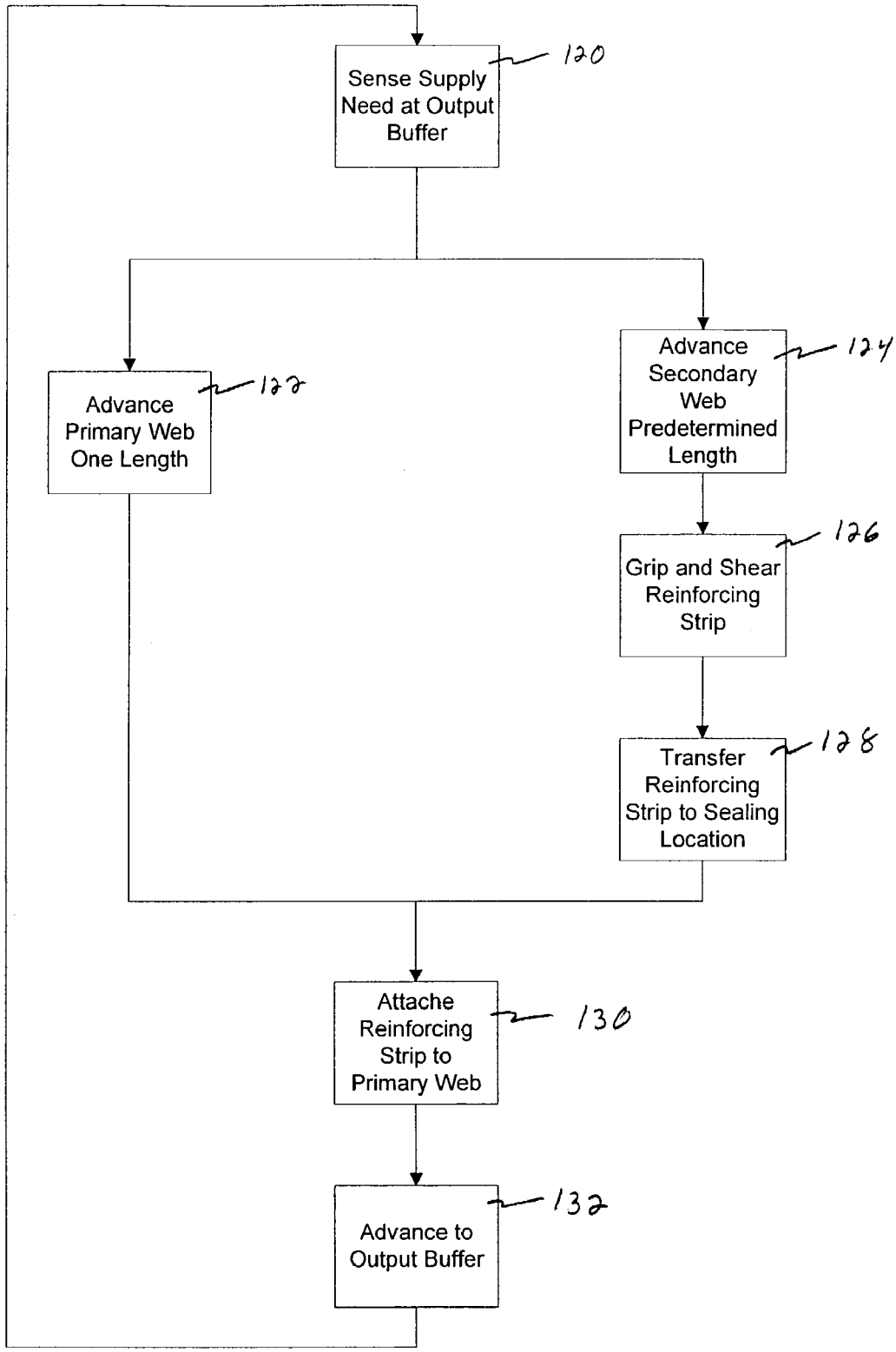
FIG. 8 is a flow chart showing the operating steps of the cutting and laminating apparatus of the present invention.

Referring now to FIG. 8 there shown a flow chart which describes the overall operation of cutting and laminating apparatus 10. Initially the system waits until a supply demand is requested from upstream equipment. At step 120 a supply need is sensed at the output buffer causing the system to initiate its cycle. Next, the system simultaneously executes multiple options. First, at step 122 the bag material, or primary web, is advanced one length. Simultaneously, reinforcing material, or secondary web material, is advanced a predetermined length. After this predetermined length has been advanced, the shear step is initiated where a reinforcing strip is created by gripping and shearing the secondary web. Next, this reinforcing strip is moved, via the applicator head (50), to a predetermined sealing location. At this point, the primary web and the reinforcing strip should be appropriately aligned to create the reinforced area. Consequently, in step 130 the reinforcing strip is attached or laminated to the primary web. Following this laminating step, the primary web is advanced to an output buffering stage. Again, this causes the system to return to its waiting state where it looks for further signals related to needs at the output buffer. Naturally, each of these steps require the coordination of various components within the various devices. However, the general operation will be consistent.

The above referenced flow diagram relates to the processing of a single strip as carried through the cutting and laminating apparatus. It should be clear from the foregoing description that the cutting and laminating apparatus is capable of cutting a single reinforcing strip while concurrently laminating a reinforcing strip to the primary web. Additionally, material is often being fed or withdrawn in appropriate amounts between various actions. For example, while the sheared strip is being transferred from the area adjacent the cross web shear (40) to the area adjacent the laminator (20), material from both the primary supply web (12) and the secondary supply web (14) is being appropriately fed and positioned for the next operation.

As previously mentioned, cross web shear (40) produces reinforcing strips very accurately and repeatedly. Consequently, the reinforced areas themselves can be very well controlled. Additionally, by using precise control motor (82) to control the position of applicator head (50), along with very precise drive rollers (24) for moving primary web (12), very precise placement of reinforcing strips can be obtained. This allows for very repeatable pitch distances to be achieved between the subsequent reinforcing strips.

Those skilled in the art will further appreciate that the present invention may be embodied in other specific forms without departing from the spirit or central attributes thereof. In that the foregoing description of the present invention discloses only exemplary embodiments thereof, it is to be understood that other variations are contemplated as being within the scope of the present invention. Accordingly, the present invention is not limited in the particular embodiments which have been described in detail therein. Rather, reference should be made to the appended claims as indicative of the scope and content of the present invention.

What is claimed is:

1. A cross web shear device for accurately shearing predetermined strips of material from a supply web traveling in a web direction, the cross web shear device comprising:

a shear blade having a curved cutting edge positioned substantially perpendicular to the supply web and perpendicular to the web direction, the shear blade having at least one cam track therein, wherein the curved cutting edge has a first end, a second end and a middle section;

a support blade positioned substantially parallel with the supply web and perpendicular to the web direction; and a blade actuator having at least one cam pin, the at least one cam pin cooperating with the at least one cam track to cause the shear blade to move through a rocking cutting motion when the blade actuator is actuated, the support blade and the shear blade positioned in a cutting relationship with one another to shear the predetermined strip of material when the shear blade moves through its rocking cutting motion such that the first end of the curved cutting edge cuts the web before the middle section of the curved cutting edge cuts the web, and the middle section of the curved cutting edge cuts the web before the second end of the curved cutting edge cuts the web.

2. The cross web shear of claim 1 wherein the shear blade extends only a predetermined distance below the support blade at any time.

3. The cross web shear of claim 1 further comprising a cam framework attached to the support blade and a shear blade cam pin attached to the shear blade for further controlling the motion of the shear blade.

4. The cross web shear of claim 3 wherein the at least one cam track includes a first cam track and a second cam track, and the at least one cam pin includes a first cam pin and a second cam pin, both the first cam pin and the second cam pin movable along a predetermined path by the actuator wherein movement of the first cam pin and the second cam pin along the predetermined path causes the shear blade to move through its rocking cutting motion.

5. The cross web shear of claim 4 wherein the cam framework includes a framework cam track cooperating with the shear blade cam pin, and wherein the cutting motion is a rocking motion controlled by the configuration of the first cam track, the second cam track, and the framework cam track.

6. A cross web shear device for accurately shearing predetermined strips of material from a supply web traveling in a web direction, the cross web shear device comprising:

a shear blade positioned substantially perpendicular to the supply web and perpendicular to the web direction, the shear blade having a first cam track and a second cam track therein, and the shear blade having a shear blade cam pin attached thereto;

a support blade positioned substantially parallel with the supply web and perpendicular to the web direction;

a blade actuator having a first cam pin and a second cam pin, both the first cam pin and the second cam pin movable along a predetermined path by the actuator, the first cam pin and the second cam pin cooperating with the first cam track and the second cam track such that movement of the first cam pin and the second cam pin along the predetermined path causes the shear blade to move through a cutting motion when the blade actuator is actuated, the support blade and the shear blade positioned in a cutting relationship with one another to shear the predetermined strip of material when the shear blade moves through its cutting motion; and a cam framework attached to the support blade for further controlling the motion of the shear blade, wherein the cam framework includes a framework cam track cooperating with the shear blade cam pin, and wherein the cutting motion is a rocking motion controlled by the configuration of the first cam track, the second cam track, and the framework cam track.

7. The cross web shear of claim 6 wherein the shear blade extends only a predetermined distance below the support blade at any time.

8. The cross web shear of claim 6 wherein the shear blade is curved.

* * * * *